United States Patent [19]

Wolfthal

[11] 4,211,462

[45] Jul. 8, 1980

[54] ELECTRICAL CONNECTOR FOR TERMINATION CORDS WITH IMPROVED LOCKING MEANS

[75] Inventor: Maurice Wolfthal, Ossining, N.Y.

[73] Assignee: Stewart Stamping Corporation, a division of Insilco Corp., Yonkers, N.Y.

[21] Appl. No.: 5,559

[22] Filed: Jan. 22, 1979

[51] Int. Cl.[2] ..... H01R 13/58

[52] U.S. Cl. ..... 339/103 M; 339/97 R; 339/99 R

[58] Field of Search ..... 339/103, 99 R, 97 R, 339/97 P

[56] References Cited

U.S. PATENT DOCUMENTS

| | | | |
|---|---|---|---|
| 3,860,316 | 1/1975 | Hardesty | 339/99 R X |
| 3,954,320 | 5/1976 | Hardesty | 339/99 R |
| 3,998,514 | 12/1976 | Hardesty | 339/99 R |

*Primary Examiner*—Roy Lake
*Assistant Examiner*—DeWalden W. Jones
*Attorney, Agent, or Firm*—Martin G. Raskin

[57] ABSTRACT

A unipartite housing for a modular connector for terminating flat cords having a plurality of conductors enclosed within a jacket. The housing has a cord receiving cavity formed therein defining a forward conductor receiving portion and a rearward jacket receiving portion, the conductor receiving portion having a plurality of parallel conductor receiving troughs provided therein. A corresponding plurality of slots are provided in aligned relationship with the troughs which receive flat contact terminals which electrically couple with respective conductors. Jacket and conductor anchoring members are provided in respective openings which communicate with the cord receiving cavity adapted to be pivotally moved into engaging relationship with the jacket and conductors respectively. The anchoring members have respective jacket and conductor engaging surfaces in which a plurality of longitudinally extending, parallel channels are formed, each of the channels being substantially vertically aligned over a respective trough so that upon pivotal movement of the anchoring members into cord engaging relationship, the effective line contact in cross-section of the conductors and the engaging surfaces is significantly increased thereby greatly improving the integrity of the affixation of the cord to the connector.

5 Claims, 10 Drawing Figures

FIG. 3
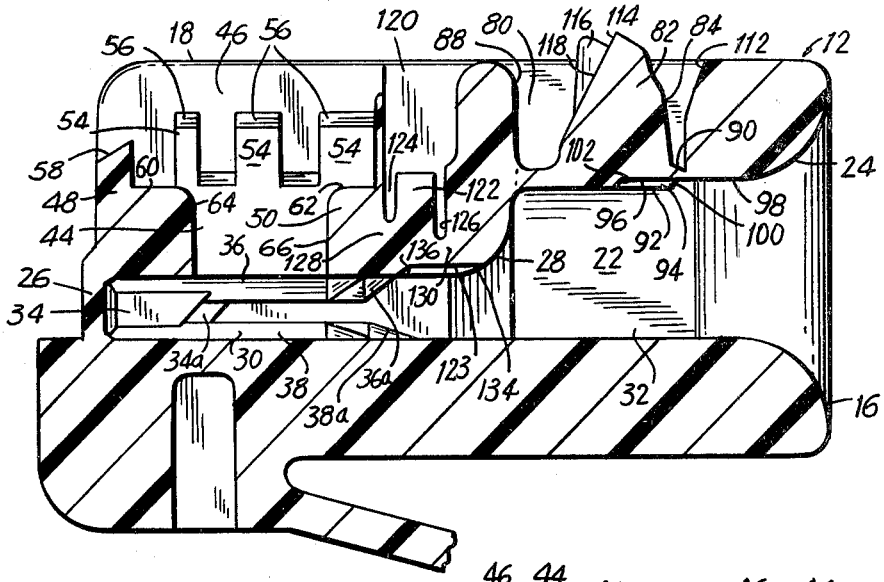
FIG. 4
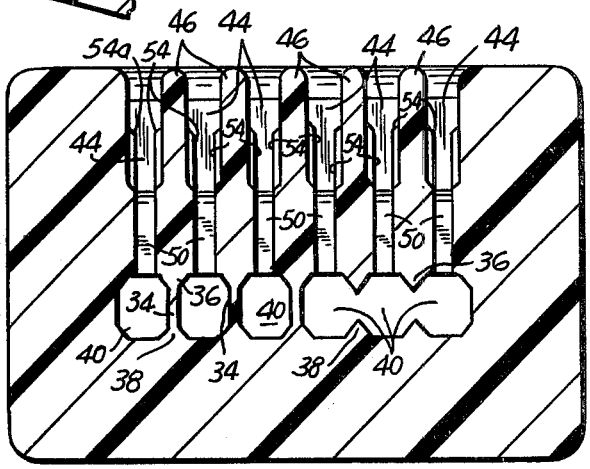
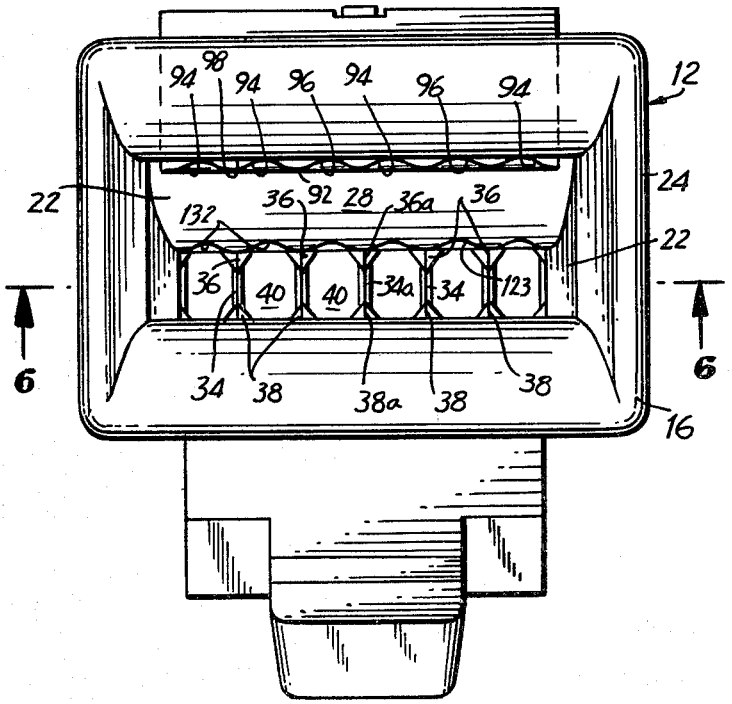
FIG. 5

ELECTRICAL CONNECTOR FOR TERMINATION CORDS WITH IMPROVED LOCKING MEANS

BACKGROUND OF THE INVENTION

This invention relates generally to electrical connecting devices for terminating cords of the modular plug type currently being utilized in the telephone industry for terminating cords extending between the base and handset of a telephone as well as between the base and a wall terminal block. More particularly, the invention relates to modular connectors of the above type wherein such connectors are provided with means for more positively securing the terminal ends of a cord to the electrical connector than was heretofore possible.

Modular plug type connectors are finding increasing use in the telephone industry in connection with terminating cords extending between the base and handset of a telephone as well as between the telephone base and the wall mounted terminal block. Generally, such connectors are used to terminate so-called "flat" cords having a multiplicity of insulated conductors arranged in a spaced linear array within an outer jacket. Various configurations of such connectors are disclosed in various patents assigned to Western Electric Company, Inc., such for example as U.S. Pat. No. 3,699,498 issued Oct. 17, 1972; 3,761,869 issued Sept. 25, 1973; 3,860,316 issued Jan. 14, 1975; and 3,954,320 issued May 4, 1976. Although such connectors have been made from two housing components bonded together (see, e.g., U.S. Pat. No. 3,761,869), it appears preferable to manufacture such connectors utilizing a so-called unipartite or integrally molded housing (see, e.g., U.S. Pat. No. 3,998,514).

In the case of connectors having housings of the unipartite type, such housings generally define an internal cord receiving cavity into which the end of a cord is inserted through a cord receiving aperture formed at one of the housing ends. The cord receiving cavity includes a jacket receiving portion adjacent the aperture and a communicating conductor receiving portion into which the individual insulated conductors, from which the outer jacket has been stripped, are received. A plurality of flat contact terminals, corresponding in number to the number of conductors of the cord, are inserted into individual grooves defined in the housing, each terminal being aligned with and electrically engaging a respective conductor. The conductors are generally of the tinsel type while the terminals have blade-like portions which engage respective conductors in a solderless connection. The flat terminals have edges which are exposed externally of the housing for engagement with respective aligned contact elements provided in the jack or the handset.

In connection with the unipartite connector housings described above, it has been conventional to provide means integral with the housings for positively securing the cord end to the connector so as to prevent separation of the connector from the cord during customer use as well as for providing strain-relief facilities for the conductors and jacket. Thus, as described in U.S. Pat. No. 3,860,316, strain relief and locking facilities for both the jacket and the conductors are provided integrally with the unipartite housing. More particularly, as described in the aforementioned patent, a first strain relief and locking means is provided which comprises an anchoring member provided within an opening formed in the housing which communicates with the jacket receiving portion of the cord receiving cavity. This jacket anchoring member is connected to the housing along one edge thereof by a transversely extending plastic hinge and along an opposed edge by a thin web of dielectric material. A second strain-relief and locking means is provided for the conductors which comprises a conductor-anchoring member which spans an opening which is aligned over the conductor receiving portion of the cord receiving cavity, the conductor-anchoring member being integrally formed with the opening walls through connecting portions. After appropriately locating the conductor and jacket portions of the cord end in the respective conductor and jacket receiving portions of the cord receiving cavity, the jacket and conductor-anchoring members are subjected to inward forces through the application of suitable tools whereby the web of the jacket anchoring member is sheared so that the latter pivots about the plastic hinge until a relatively planar surface thereof engages the jacket. Similarly, the conductor-anchoring member is sheared along irregular planes until its inner, relatively planar surface engages the conductors. In this manner, the connector is affixed to the cord and strain-relief is provided for the jacket and the conductors.

It has been found, however, that in fact, the degree of affixation of the cord to the connector afforded by the conventional jacket and conductor anchoring members, described above, is not entirely satisfactory. Thus, while the conventional construction described above has been found adequate for most normal usage of associated telephone equipment, cord-connector separation has been experienced when the associated telephone equipment has been subjected to a more rigorous usage. Thus, it is not uncommon for the cord to separate from the connector when the telephone instrument is tugged upon by children in a playful manner. In such cases, the cord will separate either intact from the connector, or alternatively, the conductors will be torn as the jacketed portion of the cord is pulled up from the connector thereby leaving short ends of the torn conductors within the cord cavity. In the latter case, the conductor-anchoring member tends to act as a knife-edge on the conductors thereby promoting failure in this manner. In either case, such cord-connector separation is quite inconvenient and necessarily requires a replacement of the entire cord-connector assembly.

SUMMARY OF THE INVENTION

Accordingly, one object of the present invention is to provide a new and improved housing for a modular plug-type connector for terminating cords of the type presently used in the telephone industry.

Another object of the present invention is to provide a new and improved housing for a modular plug-type connector of the above type wherein the integrity of the connection of the cord to the connector is improved relative to existing devices of the same type.

Briefly, in accordance with the present invention, these and other objects are attained by providing a unipartite housing for a cord terminating connector formed of a dielectric material. The housing defines a cord receiving cavity therein into which the end of a flat cord is insertable. The cavity includes a conductor-receiving portion adapted to receive through a cord-receiving aperture a plurality of conductors extending from the end of the cord from which the jacket has been stripped and a jacket receiving portion adapted to receive the jacketed portion of the cord adjacent the conductors. The conductors are respectively located within parallely extending troughs formed in the conductor-receiving portion of the cavity which themselves respectively communicate with aligned openings or slots formed in the housing adapted to receive flat contact terminals which electrically couple with the respective conductors. At least one and preferably two anchoring members extend transversely across the housing in respective openings which communicate with the cord-receiving cavity and which are integrally connected to the housing through a plastic hinge and a severable web extending between opposed transverse edges of the anchoring members and adjacent walls of the respective openings. The anchoring members each include a surface adapted to engage the cord upon suitable tools urging the same inwardly towards the cord-receiving cavity. According to the present invention, the cord engaging surface is formed with a plurality of longitudinally extending concave channels the concavity of the channels substantially conforming to the cross-section of the conductors. Each of these concave channels has a longitudinal axis which is located substantially in the same plane as the longitudinal axis of a respective conductor-receiving trough so that each channels will be parallely aligned with a respective conductor upon inserting the cord into the cord-receiving cavity of the housing. Thus, upon insertion of the cord and appropriate positioning of the conductors and the jacketed portion thereof within the cord receiving cavity and consequent inward urging of the anchoring members by suitable tools, the respective webs are severed so that the anchoring members move inwardly until the cord-engaging surfaces thereof engage the cord. In this manner, the concave surface of each of the channels applies a substantially uniform pressure on the surface of the respective conductors thereby tending to lock the cord within the housing and to provide strain relief for the cord, both to an extent not heretofore possible.

The extent of the improvement of the integrity of the connection of the cord to the connector is surprisingly great. Thus, pull-tests have shown that by providing the cord-engaging surface with a plurality of longitudinally extending concave channels in the manner described above, the strength of the cord-connector assembly approaches the tensile tearing strength of the cord itself.

DESCRIPTION OF THE DRAWINGS

A more complete appreciation of the invention and many of the attendant advantages thereof will be readily appreciated as the same becomes better understood by reference to the following detailed description when considered in connection with the accompanying drawings wherein:

FIG. 3 is a section view of the housing taken along line 3—3 of FIG. 2;

FIG. 4 is a section view of the housing taken along line 4—4 of FIG. 2;

FIG. 5 is an end view of the housing of the modular plugtype connector illustrated in FIG. 1 wherein the concave channels formed on the jacket and conductor strain relief and locking means are illustrated;

DESCRIPTION OF THE PREFERRED EMBODIMENT

Figure 1:
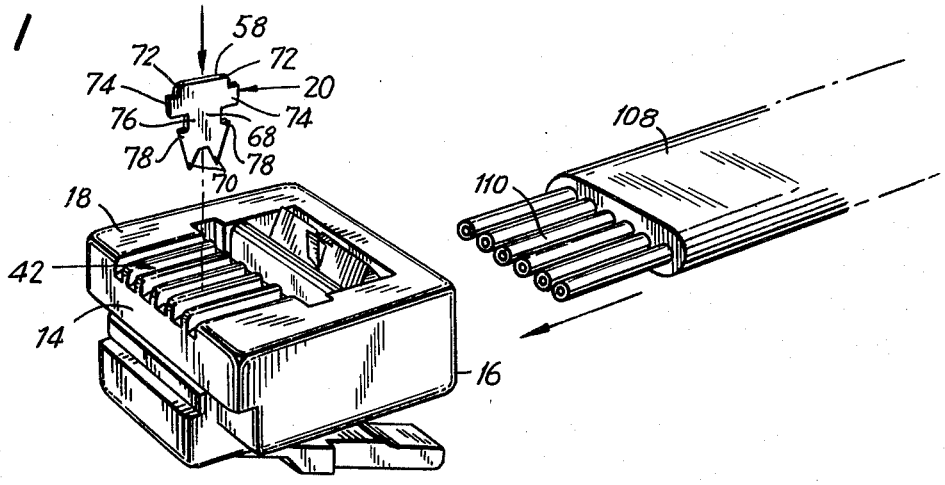
FIG. 1 is a perspective view of a modular plug-type connector incorporating the strain relief and locking means according to the present invention.

Referring now to the drawings wherein like reference characters designate identical or corresponding parts throughout the several views, and more particularly to FIG. 1, a modular plug-type connector, generally designated 10, is illustrated which is adapted to terminate the ends of a so-called "flat" cord which finds current usage in the telephone industry. Thus, such cords are used as line cords for connecting the base of the telephone to a wall terminal block and as retractile cords which interconnect the telephone base and the telephone handset. Such usage is clearly described in the Western Electric Pat. No. 3,860,316, referred to hereinabove.

Connector 10 includes a rigid, dielectric unipartite housing 12 which is formed by conventional injection molding techniques. Thus, housing 12 may be made of materials such, for example, as polycarbonate, polyamide, polystyrene, or polyester elastomers or related polymers such as ABS resin, all of which provide suitable mechanical strength and rigidity as well as adequate electrical insulation. The housing 12 has a closed forward free end 14, a cord receiving rearward end 16 and a terminal-receiving side 18 for receiving flat contact terminals 20.

Figure 7:
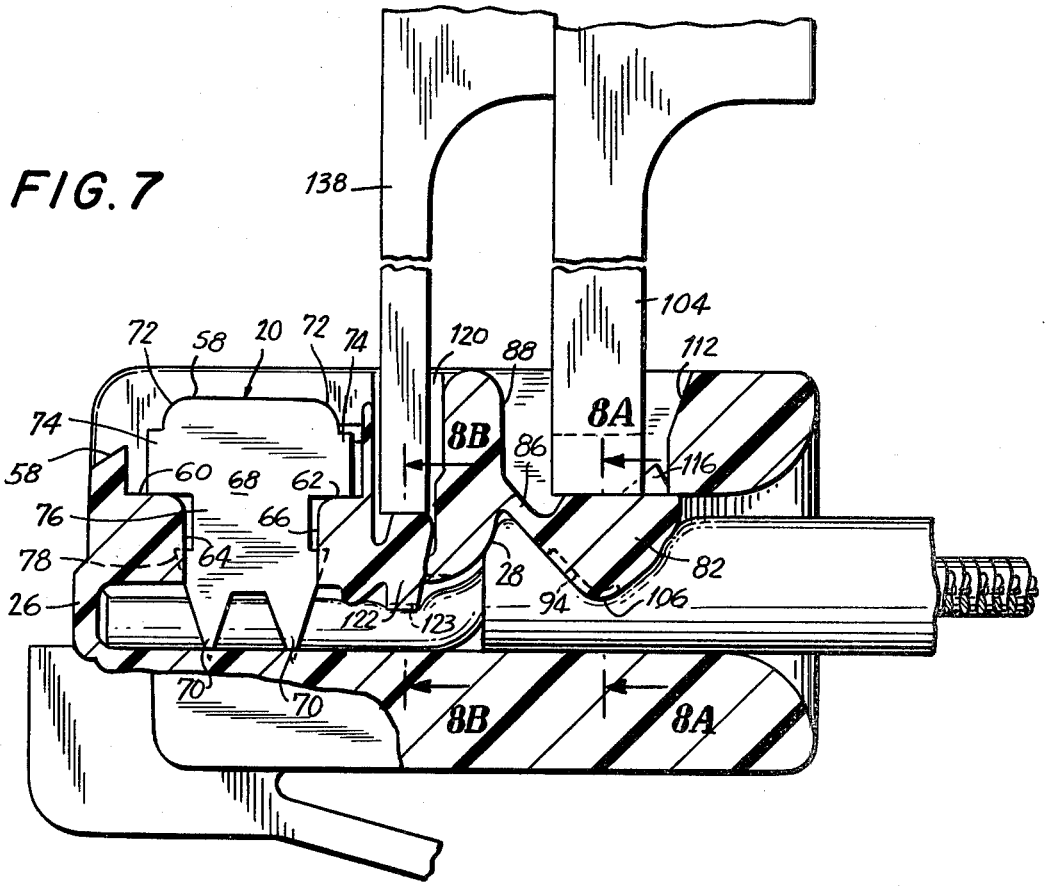
FIG. 7 is a longitudinal section view of a modular plugtype connector and associated cord shown during the connection operation of the cord to the connector.

Referring to FIGS. 3 and 5, the housing 12 defines a longitudinally extending cord-receiving cavity 22 which externally opens through a cord-receiving aperture 24 formed in the rearward end 16 of housing 12. The aperture 24 flares outwardly in order to facilitate the insertion of the cord into cavity 22. Cavity 22 is closed at its forward end by a wall 26 which defines a portion of the forward free end 14 of housing 12. A shoulder 28 formed interiorally of housing 12 extends generally transversely to the longitudinal axis of cavity 22 and defines a forward conductor-receiving portion 30 and a rearward jacket-receiving portion 32 of cavity 22. The cavity 22 substantially encloses the entire end section of the cord with the terminal end portions of the conductors (having the jacket stripped therefrom) being received in the conductor receiving portion 30 and the adjacent jacketed portion of the cord being received within the jacket receiving portion 32 (FIG. 7).

Figure 6:
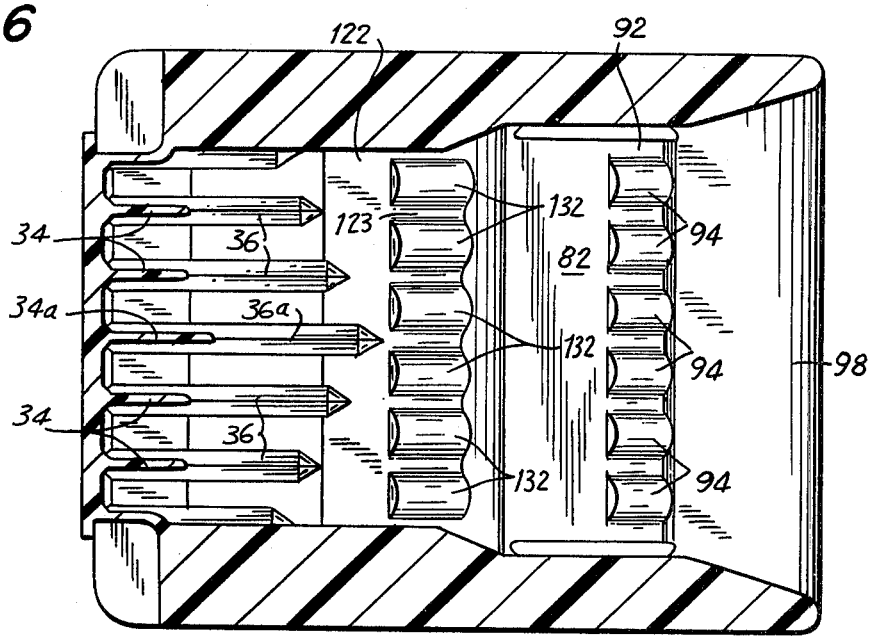
FIG. 6 is a section view of the housing taken along line 6—6 of FIG. 5.

Structure is provided within the conductor-receiving portion 30 for receiving individual ones of the conductor end portions in a manner so as to precisely locate the same, i.e., to prevent their lateral movement and to maintain the conductors in electrically isolated relationship. In this connection, it is important to precisely locate the conductors so that they are in direct aligned relationship with slots formed in the terminal receiving side 18, which slots receive the contact terminals as described below. Thus, referring to FIGS. 3–6, a plurality of longitudinally extending vertical partitions 34 are provided in the conductor-receiving portion 30 of cavity 20 and extend from the wall 26 rearwardly for a short distance. The central one 34*a* (FIG. 6) of such partitions is preferably slightly longer than the other partitions. As seen in FIG. 4, the partitions 34 are integrally joined at their upper and lower edge regions with wedge-shaped upper and lower ridges 36, 38 formed on the upper and lower walls of conductor receiving portion 30 of cavity 22. Ridges 36, 38 continue to extend rearwardly within cavity 22 beyond the rearward ends of partitions 34 and, as seen in FIG. 6, the central ridges 36*a* and 38*a* (not shown) are longest while the length of the laterally adjacent ridges become progressively shorter. This construction greatly facilitates mutual separation of the conductors upon insertion of the cord within the conductor-receiving cavity as described below. The partitions 34 and ridges 36, 38 thus define between them a plurality of conductor-receiving troughs 40 (FIG. 5). The partitions 34 effectively extend from the bottom of the troughs 40 to the top of cavity 22 to compartmentalize and isolate each conductor.

In connecting the cord to the connector 10, a portion of the cord jacket 31 is stripped to expose a length of each of the insulated conductors (FIG. 1). The cord is inserted into the aperture 24 with the shoulder 28, which is curved forwardly in the inward direction, serving to guide the conductors into the conductor-receiving portion 30. The central ridges 36*a*, 38*a* and central partition 34*a* assist in separating and guiding the conductors into two main portions and the rearward ends of partitions 34 are feathered to present a separating edge to adjacent conductors.

The end of the cord is stripped of an appropriate length of its jacket so that the exposed end portions of the conductors will extend through the conductor-receiving protion 30 of cavity 22 until their ends are located in contiguous relationship with the inner surface of wall 26. At this time, the jacketed portion of the cord will be received in the jacket-receiving portion 32 of cavity 22 as best seen in FIG. 7 where it forwardly terminates at a point somewhat rearwardly of shoulder 28.

Figure 2:
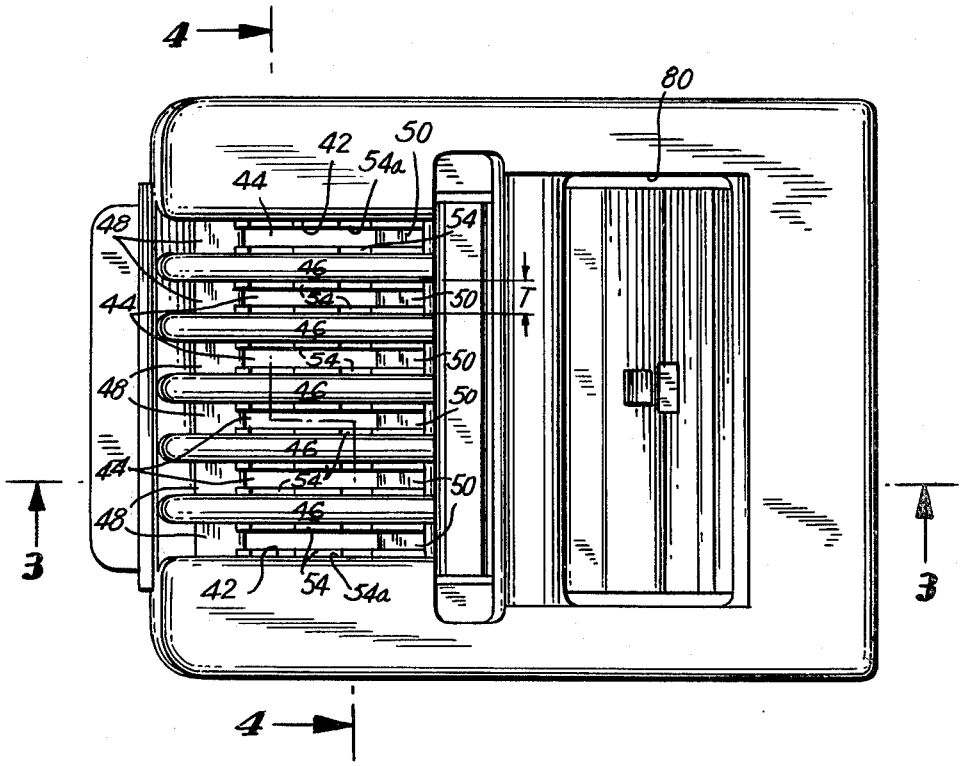
FIG. 2 is a plan view of the housing of the connector illustrated in FIG. 1 prior to the insertion of the terminals therein.

Referring now to FIGS. 1–3, the housing 12 is formed with a well 42 in which are defined a plurality of parallely spaced, longitudinally extending terminal-receiving slots 44. Each of the slots 44 are aligned over a respective one of the conductor-receiving troughs 40. Slots 44 themselves comprise the spaces between pairs of a corresponding plurality of longitudinally extending fins 46. Each pair of adjacent fins 46 are interconnected by longitudinally spaced forward and rearward webs 48, 50 respectively. The thickness T of the webs (FIG. 2) is slightly larger than the thickness of the contact terminals 20 (FIGS. 1 and 7). Thus, in order to achieve a snug fit of the terminals 20 within the slots 44 defined between the fins 46, the fins 46 have a series of vertically extending terminal locating guide ribs 54 formed on their surfaces as best seen in FIGS. 2–4. As best seen in FIG. 3, three guide ribs 54 are formed on the opposed side surfaces of each fin 46, each rib having an angled upper surface 56. The location and thickness of the guide ribs are determined by the particular configuration of the connector in a manner so as to assure that each of the terminals 20 inserted within respective slots 44 are snugly received therein and are guided so as to align as closely as possible with the longitudinal axis of the conductor located in corresponding aligned trough 40. Thus, referring to FIGS. 2 and 4, it is seen that in the present embodiment, each of the fins 46 have guide ribs 54 formed on both surfaces thereof. Guide ribs 54*a* are similarly formed on the vertical walls defining well 42. Of course, this configuration may vary with the design of each particular connector.

Each forward web 48 is defined by an upwardly inclined wire-lifting surface 58 (FIGS. 3 and 7) which serves to cam the corresponding wire of the connector receiving jack assembly (not shown) upwardly into electrical coupled relationship with the upper edge surface 58 of the particular terminal 20 during insertion of the connector into the jack. The forward and rearward webs 48, 50 are further defined by longitudinally extending shoulders 60, 62 respectively (FIG. 3) which function to limit the extent to which the terminals 20 move downwardly within slots 44 as described in greater detail below and opposed wall regions 64, 66 respectively which define the longitudinal extent of each slot 44.

As best seen in FIGS. 1 and 7, each terminal 20 is constructed of an electrical conductive material, such as gold plated phosphor bronze. The terminal 20 has a flat conductor portion 68 and a pair of insulation-piercing tangs 70. The tangs 70 provide electrical connection between the conductive portion of the conductors and the associated ones of the terminals 20. The upper edge surface 59 of the terminal has curved crowns 72 which facilitate the guidance and connection of the terminal 20 and the external jack wire during insertion of connector 10 into the jack. Each of the terminals are formed with a pair of outwardly extending shoulders 74 and a reduced mid-portion 76 that terminates at barbs 78. The overall length of a terminal 20 between the laterally outermost points of barbs 78 is greater than the length of the terminal-receiving slot defined between the opposed web wall regions 64, 66. Thus, when a terminal 20 is inserted into an associated terminal-receiving slot 44, the barbs 78 penetrate into the dielectric material which defines the slot to anchor the terminal (FIG. 7). The terminal is appropriately designed so that the points of tangs 70 penetrate into the lower wall of conductor-receiving portion 30 prior to terminal shoulders 74 engaging web shoulders 60, 62. This, together with the barbs 78, provides a stable fixation for each terminal 20 within each respective slot 44. Of course, it is understood that the tangs 70 engage and pass through the tinsel of the conductors during insertion to provide an electrical connection between the conductor and the respective terminal.

The housing 12 is constructed with facilities for both securing the connector 10 to the cord and for providing strain relief for the jacket and the conductors. Such facilities are generally described in the above-mentioned U.S. Pat. No. 3,860,316 but, according to the present invention, differ therefrom in at least one important respect as described below.

Thus, housing 12 is constructed with an opening 80 (FIGS. 2 and 3) in which a jacket anchoring member 82 having an initially external facing portion 84 is disposed. The jacket anchoring member 82 is integrally connected to housing 12 through a plastic hinge 86 extending along and interconnecting the transverse forward edge region of jacket anchoring member 82 and a rearwardly facing wall 88. The transverse rearward edge region of jacket anchoring member 82 is initially interconnected to housing 12 through a frangible portion 90 which supports jacket anchoring member 82 in its initial position as shown in FIG. 3 wherein a cord is receivable within cavity 22. The construction of the frangible portion is described in detail in U.S. Pat. No. 3,998,514. The frangible portion 90 is constructed so as to shear upon the application of an inwardly directed force thereon by a suitable tool so that the member 82 may be pivotally moved about the hinge 86 to engage the cord jacket.

Referring to FIGS. 3 and 5–8A, the jacket anchoring member 82 includes a jacket engaging surface 92 which in its initial configuration (FIG. 3) extends forwardly from frangible portion 90 to define a boundary of jacket receiving portion 32 of the cord receiving cavity 22. According to the present invention, jacket engaging surface 92 is formed with a plurality of longitudinally extending parallel concave channels 94. Each of the channels 94 formed in jacket engaging surface 92, in the preferred embodiment, has a radius of curvature of about 0.025 inches and a depth of about 0.005 inches, the innermost longitudinally extending surface portion 96 of each channel 94 being substantially flush with the upper wall 98 defining the cord-receiving aperture 24. Therefore, the outermost portions of surface 92 defined between the channels 94 protrude beyond upper wall 98 by about 0.005 inches. The rearward and forward end portions 100,102 (FIG. 3) of the channels 94 are downwardly and forwardly canted at an angle of about 30°, the rearward end portions 100 actually being formed on the lower surface of frangible portion 90.

Referring to FIG. 5, each of the channels 94 is substantially vertically aligned over the respective conductor-receiving trough 40. More particularly, the longitudinal axis of each channel 94 substantially extends in the vertical plane which contains the central longitudinal axis of a respective trough 40. In the illustrated preferred embodiment, the housing 12 is adapted to receive a cord having six parallel extending conductors, the housing thus being provided with six troughs 40. Accordingly, six parallel extending concave channels 94 are formed in jacket-engaging surface 92. Of course, the housing may be constructed for receiving cords having less or more conductors, e.g., may typically be provided with from four to eight conductor receiving troughs 40. In each case, the jacket surface 92 will be formed with a corresponding number of concave channels 94, each being in substantial vertical alignment with a respective trough.

Figure 8A:
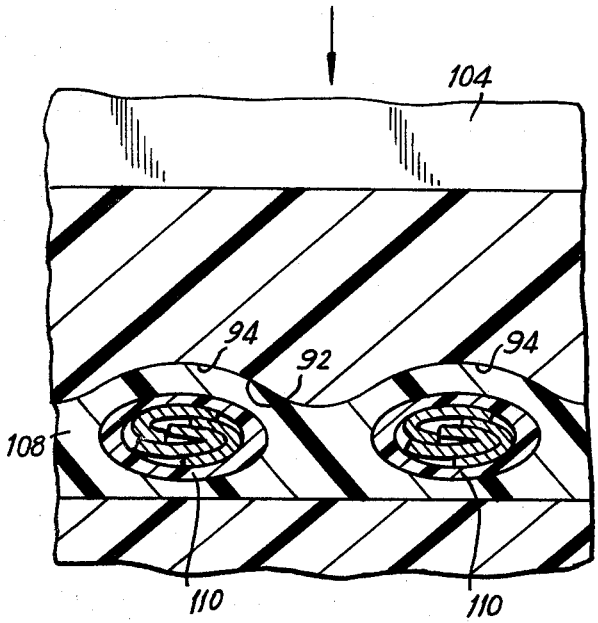
FIGS. 8A and 8B are section views of the cord-connector assembly taken along lines 8A—8A and 8B—8B of FIG. 7 illustrating the engagement of the cord engaging surfaces of the jacket and conductor strain relief and locking means with the respective cord portions.
Figure 8B:
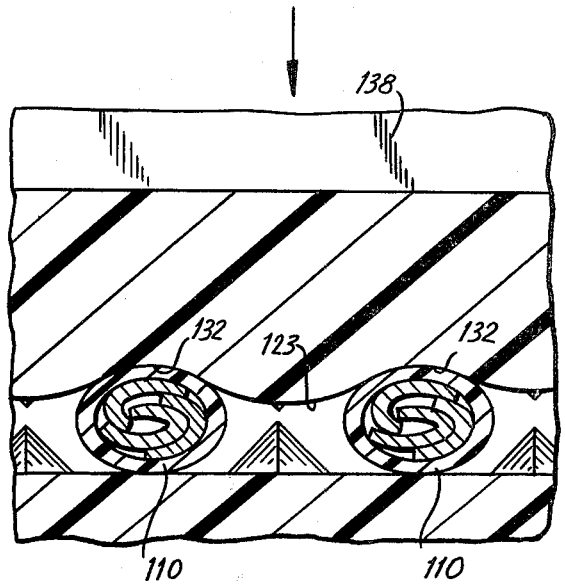

When the jacket anchoring member 82 is actuated by the downward movement of a suitable tool 104 (FIG. 7), the frangible portion 90 shears and the trailing edge 106 of jacket engaging surface 92 becomes rounded as seen in FIG. 7 and moves into clamping engagement with the jacket 108 of the cord. Referring to FIGS. 7 and 8A, member 82 continues to pivot in locking engagement with jacket 108 until it is locked in its final jacket engaging position as seen in FIG. 7 and as described in detail below. At this time the portion of jacket 108 engaged by surface 92 is deformed so as to flow and fill the channels 94 (FIG. 8A). In this manner, the area over which locking surface 92 engages jacket 108 is substantially increased thereby increasing the amount of force available to resist separation of the cord from the connector. Further, by virtue of the aligned relationship of the channels 94 and the conductor receiving troughs 40, channels 94 are also aligned over the conductors 110 enclosed within jacket 108 so that upon actuation of the jacket anchoring member 82 into clamping engagement with jacket 108, the conductors 110 are deformed as seen in FIG. 8A. The deformation of conductors 110 is such that the conductor insulation obtains a substantially oval shaped cross-section with the long axis thereof extending transversely across jacket 108. In this manner, the downwardly directed pressure exerted by the jacket engaging surface 92 is applied over a greater surface area of conductors 110 in a more evenly distributed manner than has been previously possible, i.e., when the jacket engaging surface of jacket anchoring member 82 has a planar configuration. In other words, the channels 94 cause a substantial increase in the effective line contact (in cross-section) between the conductors 110 and surrounding jacket 108 thereby increasing the locking pressure exerted by the jacket against the conductors as well as increasing the effective locking pressure between the surface 92 and the jacket 108.

The greatest deformation of the jacket 108 occurs at the area where the engaging surface 92 protrudes to its deepest extent into jacket receiving portion 32, i.e., at trailing edge 106 (FIG. 7). Since, as mentioned above, the trailing edge 106 of the jacket engaging surface 92 obtains a rounded configuration upon actuation of anchoring member 82, the controlled deformation of the jacket and enclosed conductors 108,110 are substantially continuous and, as seen in FIG. 7, occurs from a point slightly rearward of the aforementioned point of greatest deformation of the jacket and extends forwardly until the termination of channels 94. In this manner, the increased clamping engagement provided by the channels 94, which is more evenly distributed over the conductors 110 within the jacket 108, occurs over a substantial longitudinal extent of clamping surface 92.

The pivotal movement of the anchoring member 82 results in the originally external facing portion 84 moving forcefully against the side of a wall 112 which partially defines the opening 80 whereupon the anchoring member 82 is locked in its jacket engaging position by the engagement of the ledge portion 114 (FIG. 3) of anchoring member 82 with the upper wall 98. Of course, during this pivotal movement of anchoring member 82, the latter undergoes a slight deformation until it attains its locked configuration as described above. A stop 116 is centrally provided on a second external facing surface 118 which engages the wall 112 at the final stages of the pivotal actuation of the anchoring member 82, which stop prevents over-travel of the anchoring member 82 thereby preventing excessive distortion of the cord. The stop 116 and the wall 112 cooperate to positively hold anchoring member 82 in engagement with the housing 12 and the jacket 108 when retrograde forces are applied to the cord by the customer during use.

The housing 12 is also formed with additional facilities for securing the cord to the connector 10 and for providing strain relief for the conductors. An opening 120 is defined in the housing 12 forwardly of opening 80 and a conductor-anchoring member 122 of dielectric material having a conductor engaging surface 123 spans the opening, forward and rearward portions of the conductor anchoring member 122 being spaced from the housing by slots 124, 126, respectively. The forward and rearward portions of the anchoring member 122 are integrally connected to the housing by transversely extending webs 128, 130 respectively, the rearward web 130 having a smaller depth than the forward web 128 by virtue of the increased depth of the rearward slot 126 relative to forward slot 124.

According to the present invention, the conductor engaging surface 123 of conductor anchoring member 122 is formed with a plurality of longitudinally extending, parallel concave channels 132. The channels 132 each have a radius of curvature of about 0.025 inches and a depth of about 0.005 inches. Similarly to the jacket engaging channels 94, the rearward and forward end portions 134, 136 (FIG. 3) are downwardly and forwardly canted at an angle of about 30°, the rearward end portions extending to the shoulder 28.

Referring to FIG. 5, each of the channels 132 is substantially vertically aligned over a respective conductor-receiving trough 40. Thus, in the illustrated preferred embodiment, six parallel extending concave channels 132 are formed in the conductor engaging surface 123.

When the conductor anchoring member 122 is actuated by the downward movement of a suitable tool 138 (FIG. 7), the rearward web 130, by virtue of its reduced depth shears whereby the anchoring member 122 moves downwardly until the conductor engaging surface 123 lockingly engages conductors 110, the forward web 128 being deformed. As thus seen in FIG. 8B, the conductor engaging surface 123 engages the conductors 110 in a manner such that each conductor 110 is engaged and deformed by a respective concave channel 132. The deformation of the conductors is such that the latter obtain a substantially oval shape cross-section with the longitudinal axis thereof extending transversely across the conductor receiving portion 30. In this manner, the downwardly directed pressure exerted by the conductor engaging surface 123 is applied over a greater surface area of conductors 110 in a more evenly distributed manner than had been previously possible, i.e., when the conductor engaging surface has a planar configuration. The channels 132 result in a substantial increase in the effective line contact (in cross-section) between the conductors 110 and the conductor engaging surface 123 thereby increasing the locking pressure exerted by the latter on the conductors.

The conductor anchoring member 122 is locked in engagement with the conductors by the frictional engagement of the sheared housing wall with the rearward wall of the anchoring member 122.

It should be noted that the radius of curvature of the channels formed in the jacket and conductor engaging surfaces is determined by the particular diameter of the conductors used in the line cord. Thus, the radius of curvature is chosen to be on the same order as but slightly larger than the radius of curvature of the individual insulated conductors. In the present embodiment, the outside nominal diameter of each insulated conductor is approximately 0.040 inches. In this manner, the oval-shaped cross-sectional configuration of the conductors will be obtained thereby advantageously increasing the effective line contact pressure (in cross-section) of the respective jacket and conductor engaging surfaces as described above.

By providing the jacket and conductor anchoring members with the concave channels in the manner described above, the integrity of the affixation of the cord to the connector is increased to a surprising extent. Thus, pull tests have been conducted on cord-connector assemblies constructed according to the prior art, i.e., with the jacket and conductor anchoring members having planar cord engaging surfaces and on cord-connector assemblies constructed according to the present invention, i.e., with longitudinally extending parallel concave channels formed on the cord engaging surfaces of the jacket and conductor anchoring members which are aligned with the conductor receiving troughs. Thus, field tests performed on conventionally constructed cord-connector assemblies have shown that it is not uncommon for failure to occur upon the application of about 14 pounds of force tending to separate the cord from the connector. However, the same tests performed on assemblies constructed according to the present invention have shown a minimum separation force of 25 pounds to be required and that on the average, the cord connector assembly of the present invention can withstand pull forces of 35 pounds without failure. Such forces approach the actual failure strength of the cord itself. Accordingly, it is seen that the present invention provides an unexpected increase in magnitude of the integrity of the connection of the cord and the connector.

Figure 9:
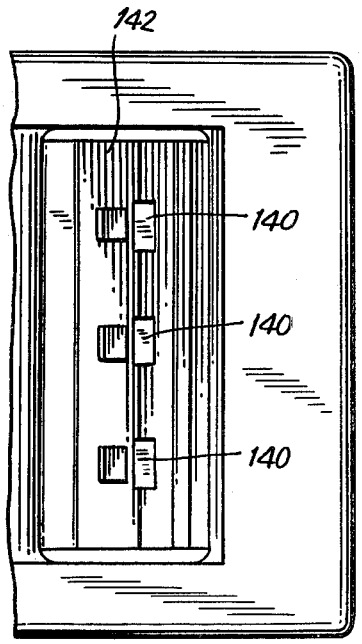
FIG. 9 is a partial plan view of a modular plug-type connector having a relatively large transverse dimension illustrating means for providing a uniform cord engaging pressure between the cord engaging surface of the jacket strain relief and locking means and the cord.

Finally, referring to FIG. 9, a partial plan view of a connector having a relatively large transverse dimension, i.e., adapted to receive cords including on the order of 8 parallel conductors, is illustrated. It has been found that in the connection of cords to such connectors, the engagement pressure of the jacket anchoring member on the cord jacket varies over the transverse dimension thereof. In order to overcome this problem, a central and a pair of side shoulders 140 are provided on the jacket anchoring member 142, shoulders 140 being adapted to move into locking engagement with the upper wall 98 (FIG. 3) of the housing. In this manner a substantially uniform pressure is exerted by the jacket engaging surface on the anchoring member 142 of the cord.

Obviously, number modifications and variations of the present invention are possible in the light of the above teachings. For example, it is within the scope of the present invention to provide longitudinally extending channels on the lower surfaces of the cord-receiving cavity in opposed relationship to the jacket and conductor anchoring members similarly aligned with the conductor receiving troughs, either in lieu of or in addition to the channels illustrated in the present embodiment. It is therefore to be understood that within the scope of the appended claims, the invention may be practiced otherwise than is specifically described herein.

What is claimed is:

1. An electrical connector housing for terminating a cord adapted to receive a plurality of insulated conductors enclosed within a jacketed cord and for making electrical contact external to the conductor, comprising: a unipartite dielectric housing having a forward free end and a rearward cord input end having an aperture formed therein opening into a cord-receiving cavity formed within the housing, said cord-receiving cavity having a forward conductor-receiving portion and a rearward jacket-receiving portion; a plurality of parallely extending conductor-receiving troughs extending in a longitudinal direction in said forward conductor-receiving portion of said cavity; a plurality of openings adapted to receive terminal members, each of said openings being aligned and communicating with a respective conductor-receiving trough; and at least one anchoring member extending transversely across said housing connected through a hinge portion at one transversely extending end thereof and through a severable web at the other end thereof to said housing, said anchoring member having a surface which is movable at least partially into the cavity for engaging portions of the cord to secure the cord within the housing and to prevent unintended lateral and longitudinal movement thereof, a plurality of longitudinally extending, mutually parallel concave channels defined by said cord-engaging surface of said anchoring member, each of said concave channels communicating with said cavity and being substantially aligned with a respective one of said conductor-receiving troughs, whereby upon said web being separated from the housing and said anchoring member being pivotally moved into said cavity, said cord-engaging surface engages said cord in a manner such that each of said concave channels applies a locking pressure along a peripherally extending portion of a respective one of said insulated conductors.

2. The electrical connector housing of claim 1 wherein said at least one anchoring member comprises a first jacket anchoring member having a surface which is movable at least partially into the rearward jacket-receiving portion of said cavity for engagement with a jacketed portion of the cord to anchor the jacket against unintended lateral and longitudinal movement, said concave channels formed in said jacket-engaging surface of said first jacket anchoring member being aligned with corresponding insulated conductors enclosed within said jacketed portion, whereby upon said jacket-engaging surface engaging said jacket, movement restraining pressure is applied via the surface of said concave channels to said jacket portion along peripherally extending portions of respective ones of said insulated conductors.

3. The electrical connector housing of claim 2 wherein said at least one anchoring member further comprises a second conductor anchoring member having a surface which is movable at least partially into the forward conductor-receiving portion of said cavity for engagement with the insulated conductors to anchor the same against unintended lateral and longitudinal movement, said concave channels formed in said conductor-engaging surface of said second conductor anchoring member being aligned with corresponding insulated conductors, whereby upon said conductor-engaging surface engaging said conductors, movement restraining pressure is applied via said concave channels formed in said surface directly to peripherally extending portions of the surfaces of respective ones of said insulated conductors.

4. The electrical connector housing of claim 1 wherein said at least one anchoring member comprises a conductor anchoring member having a surface which is movable at least partially into the forward conductor-receiving portion of said cavity for engagement with the insulated conductors to anchor the conductors against unintended lateral and longitudinal movement, said concave channels formed in said conductor-engaging surface of said conductor member being aligned with corresponding insulated conductors, whereby upon said conductor-engaging surface engaging said conductors, movement restraining pressure is applied via said concave channels formed in said surface directly to peripherally extending portions of the surfaces of respective ones of said insulated conductors.

5. The electrical connector housing as defined in claim 1 wherein said anchoring member is formed within an opening in the housing that communicates with the cavity and the pivotal movement of the anchoring member causes the anchoring member to lock under one of the walls defining the opening to secure the anchoring member in engagement with the cord.

* * * * *